US012135026B2

(12) United States Patent
Gossen

(10) Patent No.: US 12,135,026 B2
(45) Date of Patent: Nov. 5, 2024

(54) SCROLL MACHINE WITH INJECTION AND REFRIGERATION SYSTEM

(71) Applicant: BITZER KUEHLMASCHINENBAU GMBH, Sindelfingen (DE)

(72) Inventor: Dimitri Gossen, Altdorf (DE)

(73) Assignee: BITZER KUEHLMASCHINENBAU GMBH, Sindelfingen (DE)

( * ) Notice: Subject to any disclaimer, the term of this patent is extended or adjusted under 35 U.S.C. 154(b) by 0 days.

(21) Appl. No.: 18/233,687

(22) Filed: Aug. 14, 2023

(65) Prior Publication Data

US 2024/0060493 A1 Feb. 22, 2024

(30) Foreign Application Priority Data

Aug. 16, 2022 (DE) ..... 102022120678.5

(51) Int. Cl.
*F04C 18/02* (2006.01)
*F04C 27/00* (2006.01)
*F04C 29/00* (2006.01)

(52) U.S. Cl.
CPC ..... *F04C 18/0215* (2013.01); *F04C 18/0261* (2013.01); *F04C 27/004* (2013.01); *F04C 29/0007* (2013.01)

(58) Field of Classification Search
CPC ..... F04C 18/0215; F04C 18/0261; F04C 27/004; F04C 29/0007
See application file for complete search history.

(56) References Cited

U.S. PATENT DOCUMENTS

2011/0236242 A1 9/2011 Su et al.

FOREIGN PATENT DOCUMENTS

| | | | |
|---|---|---|---|
| CN | 201896746 U | | 7/2011 |
| DE | 102015100112 A1 | | 7/2015 |
| EP | 3477113 A1 | | 5/2019 |
| EP | 3578823 B1 | | 3/2021 |
| JP | H08303361 A | | 11/1996 |
| JP | 5436982 B2 | | 12/2013 |
| JP | 2015113817 A | * | 6/2015 |

(Continued)

OTHER PUBLICATIONS

English Translation WO-2020215663-A1 (Year: 2019).*

(Continued)

*Primary Examiner* — Shafiq Mian
(74) *Attorney, Agent, or Firm* — Nath, Goldberg & Meyer; Jerald L. Meyer

(57) ABSTRACT

A scroll machine with an injection for a medium has a machine housing with a longitudinal axis. A first scroll unit with scroll channel is formed by a scroll rib. A second scroll unit has a first side and a second side opposite the first side. A scroll channel formed by a second scroll rib is provided on the first side, and a high-pressure chamber is arranged on the second side of the second scroll unit and connected with the scroll channel via a passage. These are arranged in the machine housing along the longitudinal axis. The first scroll unit and the second scroll unit engage with each other to form pressure chambers. The first scroll unit can be moved relative to the second scroll unit along an orbital path. An intermediate base is provided along the longitudinal axis between the second scroll unit and the high-pressure chamber.

27 Claims, 5 Drawing Sheets

(56) References Cited

FOREIGN PATENT DOCUMENTS

| | | | | |
|---|---|---|---|---|
| JP | 2016011620 | A | | 1/2016 |
| WO | WO-2020215663 | A1 | * | 10/2020 |

OTHER PUBLICATIONS

English Translation JP-2015113817-A (Year: 2013).*
Office Action issued Jun. 22, 2023, in parallel application DE 102022120678.5.
Office action issued Nov. 9, 2023, in corresponding parallel application EP 23181519.2.

* cited by examiner

SCROLL MACHINE WITH INJECTION AND REFRIGERATION SYSTEM

FIELD

The present invention relates to a scroll machine with an injection for a medium, in particular a refrigerant and a refrigeration system with such a scroll machine.

BACKGROUND

Scroll machines are fluid energy machines and are already known from the prior art in different configurations. Scroll machines include, for example, scroll compactors, scroll compressors/spiral compressors or scroll expanders.

Known scroll machines typically have two interacting scroll units, each with at least one scroll rib forming at least one scroll channel. The scroll ribs of the scroll units engage or intermesh to form pressure chambers.

Both the respective scroll channel and the scroll rib forming the scroll channel are formed in the form of an evolvent of a circle, with the two scroll units being movable relative to one another. A common structural design of scroll machines has a stationary scroll unit and a movable scroll unit, with the movable first scroll unit being moved along an orbital path relative to a second scroll unit.

According to the displacement principle, a medium, for example a refrigerant, is compressed or compacted in a compactor or a compressor by a relative movement of the two scroll units. During this relative movement, the medium in the pressure chambers is displaced along the scroll channels from an outer end area to an inner end area, and vice versa, with the medium in the respective pressure chamber undergoing a change in volume.

WO 2018 019 372 A1, for example, describes such a generic scroll machine, which can be used in a refrigeration system with a refrigerant cycle. Such refrigeration systems can have a variety of uses, such as cooling a secondary fluid such as air, or cooling components or equipment. The cooling or heating load of refrigeration systems can vary greatly with ambient conditions, occupancy levels, and other load requirements.

One way to improve the overall efficiency of a refrigeration system is to use what is known as an economizer cycle, for example. An economizer medium flow diverted from a main medium flow is vaporized by an economizer cycle and used to supercool a remaining portion of the main medium flow.

The diverted medium of the economizer medium flow is introduced or injected into a closed pressure chamber in the scroll machine. It is possible to vary between different operating modes by switching the injection on or off.

In the past, the above-described scroll machines with injection and refrigeration systems with an economizer cycle and a scroll machine with injection have proven themselves, but it has been found that routing the medium to be injected requires complex component geometry.

SUMMARY

It is the object of the present invention to propose a scroll machine and a refrigeration system of the type described at the outset, which eliminates the disadvantages known from the prior art in an expedient manner and to provide a scroll machine and a refrigeration system which can route the medium to be injected in a simple manner to the injection port in a scroll channel.

The scroll machine according to the invention for injecting a medium has a machine housing with a longitudinal axis, wherein a first scroll unit, a second scroll unit and a pressure chamber are arranged in the machine housing along the longitudinal axis. The first scroll unit has a first scroll channel formed by a first scroll rib. The second scroll unit has a first side and a second side opposite the first side in the longitudinal axis, wherein a second scroll channel formed by a second scroll rib is formed on the first side. The high-pressure chamber is arranged in the longitudinal axis on the second side of the second scroll unit and is connected to the second scroll channel via a passage in the second scroll unit, wherein an intermediate base is provided between the second scroll unit and the pressure chamber. In addition, the first scroll unit and the second scroll unit engage with each other to form pressure chambers, and the first scroll unit can be routes along an orbital path relative to the second scroll unit. A line is provided for injecting the medium, which line connects a housing port to an injection port in the second scroll channel, the line being routed from the housing port past the high-pressure chamber through the intermediate base to the injection port.

The present invention is based on the idea of routing the conductor for supplying the medium to be injected to the second scroll unit, bypassing the high-pressure chamber. Because the conductor is not routed through the high-pressure chamber, the heat input into the medium to be injected is reduced. The efficiency of the scroll machine can be improved by this measure. A simple design and simple installation also result for the proposed scroll machine. The intermediate base mechanically decouples the second scroll unit from the pressure forces from the high-pressure chamber, as a result of which the second scroll unit is subjected to significantly lower forces.

An advantageous configuration of the present invention provides that the intermediate base is supported on the machine housing. Preferably, the intermediate base is disc-shaped and can more preferably be operatively connected with or abutting the machine housing over the circumference, the intermediate base being held on the machine housing with axial support at least in one of the two diametrical directions along the longitudinal axis. The intermediate base is preferably held supported on the machine housing on the side facing the second scroll unit by means of an axial lock or a shoulder on the machine housing.

According to a refinement, the intermediate base can enclose or encompass the high-pressure chamber together with the machine housing. Accordingly, the intermediate base can form a wall of the high-pressure chamber, wherein the intermediate base can more preferably close the high-pressure chamber in the machine housing in the manner of a cover or plug. The machine housing or a machine housing section can be pot-shaped, with the intermediate base being able to be inserted with a precise fit into a pot-shaped section. The axial lock described above can be arranged on the side facing away from the high-pressure chamber, so that a pressure present in the high-pressure chamber pushes or presses the intermediate base against the axial lock. As a result, the position of the intermediate base can be easily specified.

In addition, a first sealant can be arranged between the intermediate base and the machine housing, which seals the high-pressure chamber and prevents leakage between the intermediate base and the machine housing.

Furthermore, it is preferred if the line has a first intermediate space according to a refinement of the invention, the first intermediate space being arranged between the intermediate base and the machine housing. In a preferred configuration, the intermediate space is enclosed jointly by the intermediate base and by the machine housing and forms a cross-sectional enlargement of the line, preferably in a circumferential direction in relation to the longitudinal axis. When installing the intermediate base, it is therefore not absolutely necessary to position the intermediate base exactly in or on the machine housing, so that the medium to be injected can be transferred from a section of the line in the machine housing into the section(s) of the line in the intermediate base.

A preferred refinement provides that the first intermediate space is formed by a preferably circumferential radial groove in an outer lateral surface of the intermediate base and/or an inner lateral surface of the machine housing. In particular, it is preferred if the intermediate base is designed as a cylindrical cover or plug, if the first intermediate space is formed by a circumferential radial groove in the outer cylindrical lateral surface, which on the one hand enables simple production and on the other hand the intermediate base can be installed in the machine housing without taking into account the alignment.

Furthermore, it has proven to be advantageous if the line in the intermediate base comprises a first line section and a second line section, and that the first line section and the second line section are arranged in an L-shape. The first line section and the second line section are preferably each formed along a straight line which intersect at a common point of intersection. Even more preferably, the first line section is oriented in a radial direction with respect to the longitudinal axis and the second line section is oriented in an axial direction. The first line section and the second line section can be formed, for example, by a blind hole or by an axial puncture, or can be formed by a primary or reshaping process in the intermediate base. It is also conceivable that the line can be formed by one or more tubular conductors, which are arranged in a corresponding recess in the intermediate base.

Furthermore, it has proven to be advantageous if the line in the intermediate base comprises at least two lines connected in parallel. The at least two lines connected in parallel can be arranged, preferably evenly distributed, over the circumference with respect to the longitudinal axis. As a result, a thermal load on the intermediate base can be evenly distributed, in particular over the circumference. Furthermore, pressure losses can be reduced and, furthermore, the effective line cross section can be increased, as a result of which further pressure losses can be reduced. This also makes it possible to realize a homogeneous distribution of the medium to be injected over the circumference, independently of the orientation and alignment of the intermediate base. When installing the intermediate base, it is no longer necessary to align the intermediate base with respect to the machine housing.

According to a preferred refinement, the second scroll unit is arranged in an axially routed manner on the intermediate base. The second scroll unit is preferably routed on the intermediate base by a type of radial bearing, as a result of which the second scroll unit is mechanically decoupled from the intermediate base. As a result of this measure, the second scroll unit is exposed to lower loads since the intermediate base absorbs the majority of the pressure load of the high-pressure chamber.

In addition, it has proven to be advantageous if the line between the intermediate base and the second scroll unit has a second intermediate space, which is preferably enclosed jointly by the intermediate base and the second scroll unit. The second intermediate space preferably forms a cross-sectional widening of the line in relation to the longitudinal axis in a circumferential direction. When installing the second scroll unit, it is therefore not necessary to position the second scroll unit in alignment with the intermediate base so that the medium to be injected can be transferred from the section of the line in the intermediate base to a section of the line in the second scroll unit.

A preferred refinement of the present invention provides that the second intermediate space is ring-shaped. Due to the ring-shaped configuration of the intermediate space, the medium to be injected can be distributed homogeneously on the second side of the second scroll unit.

In addition, a refinement of the present invention can provide that the second intermediate space surrounds the passage along the longitudinal axis.

Furthermore, it can be advantageous if, according to the invention, the second intermediate space is formed by annular projections arranged telescopically along the longitudinal axis. Preferably, the intermediate base and the second scroll unit each have at least one annular projection to form the second intermediate space, with the two annular projections preferably forming the above-mentioned radial bearing between the second scroll unit and the intermediate base. Due to the telescopic arrangement of the annular projections, tolerance compensation in the axial direction can take place while the second intermediate space is formed at the same time.

According to a refinement, the second intermediate space can be sealed by second sealants, the second sealants preferably being arranged on the corresponding annular projections opposite one another in the radial direction.

According to a refinement, the line can be formed in the second scroll unit as an axially oriented opening, in particular a bore. It is preferred if the opening is aligned parallel to the longitudinal axis, as a result of which the length of the line in the second scroll unit is kept as short as possible. Such a line can be produced in a particularly simple manner.

Furthermore, according to a refinement of the present invention, it can be provided that the injection port comprises a recess in the scroll rib. The recess is preferably designed in the manner of a circular groove. The recess can also extend from a scroll channel base of the second scroll channel on the first side of the second scroll unit in the axial direction in the direction of a second scroll rib tip over preferably more than 2% of a channel height of the second scroll channel and preferably not more than 50% of the channel height, even more preferably not more than 25% of the channel height.

The recess in the scroll rib should have a depth which is on the order of between about 25%-200%, based on the cross-section of the injection port.

Furthermore, it has proven to be advantageous if the injection port is arranged, at least in sections, in the base of the channel.

A preferred refinement of the present invention provides that the injection port extends over a transition area between the second scroll channel base and the second scroll rib and has a first port section, which is formed in the second scroll channel base, and has a second port section, which formed through the recess in the second scroll rib. Such an arrangement of the injection port in the transition area between the second scroll channel base and the second scroll rib can prevent the first scroll rib tip of the first scroll rib of the first scroll unit or a seal of the first scroll rib from coming into contact with the injection port. Such contact could damage both the injection port and/or the first scroll rib tip or the seal at the scroll rib tip.

It has also proven to be advantageous if the section of the line in the second scroll unit is designed in steps, with the stepped configuration tapering starting from the second side of the second scroll unit towards the first side of the second scroll unit. The stepped configuration can be implemented by a stepped design of the opening or by a nozzle inserted into the opening. As an alternative to the stepped configuration, the opening or the nozzle can also be conical. The opening can preferably be in the form of a bore with a circular cross section. However, it is also possible to configure the opening in the shape of a crescent.

A refinement of the present invention also provides that the line and/or the injection port comprises a check valve. Preferably, the volume between the injection port and the check valve is as small as possible, which is why in a particularly preferred configuration the check valve is arranged in the section of the line in the second scroll unit. The check valve can also be arranged in the line in the area of the intermediate base or in the line in the machine housing, preferably in the area of the housing port.

In addition, it can be advantageous if the line is thermally insulated. In addition to thermal insulation around the line, it can also be useful in addition or as an alternative to provide the side of the intermediate base facing the high-pressure chamber with thermal insulation in order to avoid unnecessary heating of the medium to be injected in the line.

According to a refinement of the present invention, the second scroll unit is stationary. The second scroll unit should preferably not move relative to the first scroll unit and the machine housing when the scroll machine is operated as intended.

A refinement of the present invention provides that the second scroll unit is connected to a main bearing housing, and that the second scroll unit, together with the main bearing housing, surrounds the first scroll unit.

According to a refinement, it can be provided that the high-pressure chamber is connected to an outlet via a pressure connection. The pressure connection can be arranged in a plane transverse to the longitudinal axis offset to the passage and can more preferably be arranged in the pressure chamber along the longitudinal axis on the opposite side of the passage. The stepped arrangement of the passage and the pressure connection is intended to ensure that pressure pulsations are reduced by viscous processes and that the medium coming out of the passage cannot flow out of the scroll machine directly through the pressure connection.

A backflow area can be provided in the high-pressure chamber, which forces an S-shaped flow path from the passage through the pressure connection to the outlet. The backflow area promotes damping of pulsations and reduces pressure fluctuations in the medium discharged through the outlet.

It has also proven to be advantageous if the return flow area is formed by a recess formed in the intermediate base on the side facing the high-pressure chamber and the pressure connection, with the pressure connection oriented towards the recess protruding into the high-pressure chamber.

In addition, it has proven to be advantageous if the pressure connection is operatively connected with the intermediate base in a contact area to form the flow area, and that the contact area is arranged on an imaginary connecting line in a plane perpendicular to the longitudinal axis between the pressure connection and the passage.

According to a refinement, a check valve can be provided, which is arranged between the high-pressure chamber and the outlet. The check valve can be arranged both in the outlet and in the pressure connection, with the check valve particularly preferably being inserted in the form of a socket in the pressure connection. This results in a particularly compact and simple design.

A further aspect of the present invention relates to a refrigeration system with a scroll machine as described above.

The refrigeration system preferably has an economizer cycle, having an expansion element and a heat exchanger. The main medium flow coming from the outlet of the scroll machine is divided into an economizer medium flow and the refrigeration cycle medium flow, the medium of the economizer medium flow flowing through the economizer cycle. The expansion element and the heat exchanger of the economizer cycle downstream of the expansion element are used to cool the medium in the refrigeration cycle, with the economizer medium flow being routed through the economizer cycle to the housing port for injection in the scroll machine.

BRIEF DESCRIPTION OF THE DRAWINGS

Two exemplary embodiments of the present invention are described in detail below with reference to the accompanying figures. In the figures.

DETAILED DESCRIPTION

Figure 1:
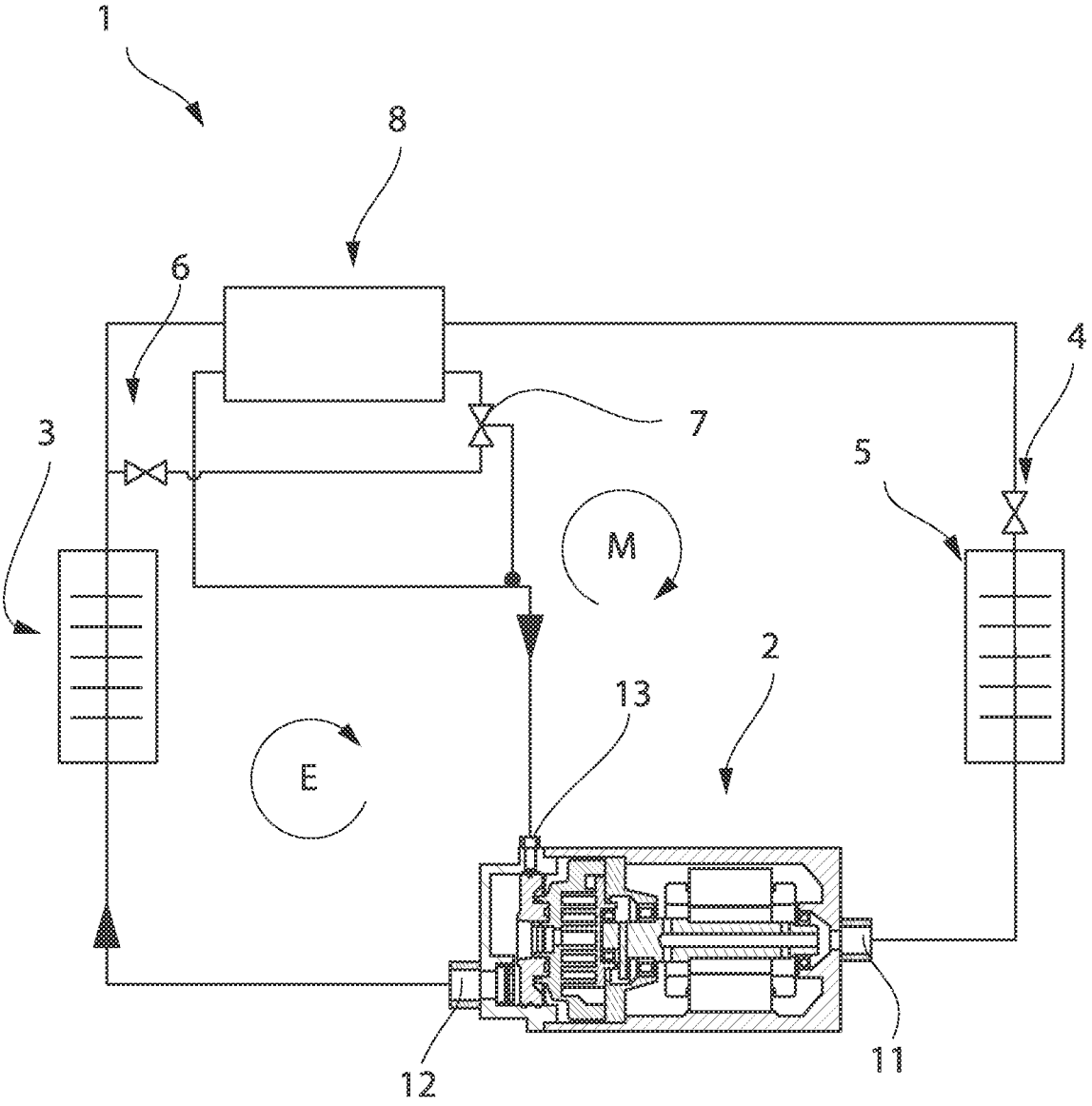
FIG. 1 shows a greatly simplified and schematic representation of a refrigeration system with a refrigeration cycle, an economizer cycle and with a scroll machine according to the invention.

Identical or functionally identical parts or features are identified with the same reference numerals in the following detailed description of the figures. Furthermore, not all identical or functionally identical parts or features are provided with a reference numeral in the figures.

FIG. 1 shows a preferred embodiment of a refrigeration system 1 with a scroll machine 2, a refrigeration cycle M and an economizer cycle E for injecting a medium into scroll machine 2. Refrigeration system 1 comprises scroll machine 2 designed as a scroll compressor, a condenser 3, a first expansion element 4 and an evaporator 5. A medium, preferably a refrigerant, flows through refrigeration system 1 in the direction indicated by the arrows, first from an outlet 12 of scroll machine 2 in sequence to condenser 3, a heat exchanger 8 described hereinafter, first expansion element 4, evaporator 5 and finally back through an inlet 11 into scroll machine 2.

Figure 2:
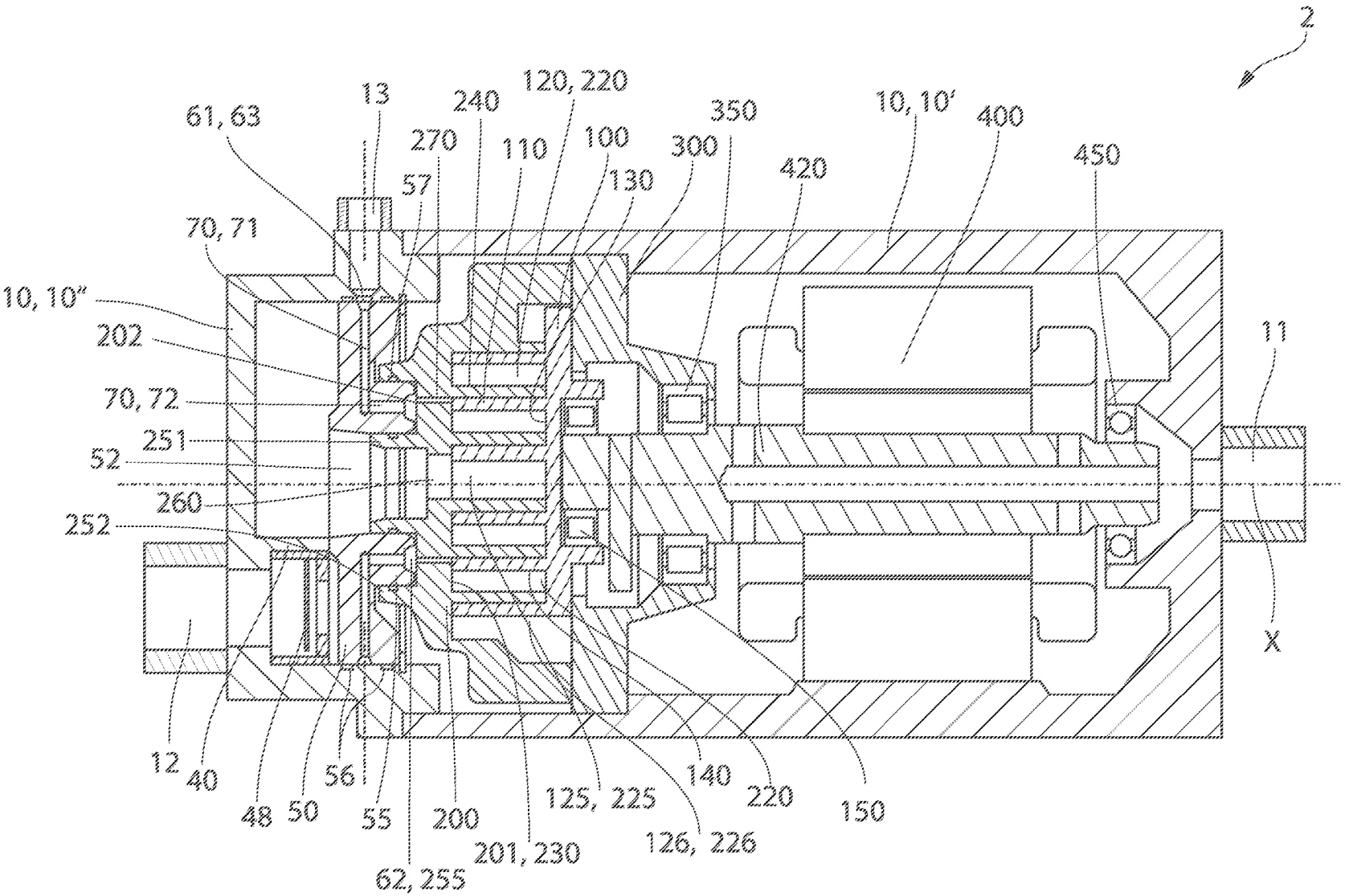
FIG. 2 shows an enlarged, simplified sectional representation of the scroll machine according to FIG. 1 according to a second exemplary embodiment.

As can be seen from FIG. 2, an economizer cycle E for an economizer medium flow branches off from a main medium flow at a junction downstream of condenser 3. A remaining refrigeration cycle media flow flows through the previously described refrigeration cycle M from the junction to inlet 11 of scroll machine 2.

Economizer cycle E comprises a second expansion element 7 and heat exchanger 8, with the economizer medium flow first being routed from second expansion element 7 to heat exchanger 8 and then to a housing port 13 of scroll machine 2, which will be described in detail hereinafter.

A solenoid valve 6 can be provided to open or close economizer cycle E.

In heat exchanger 8, the economizer medium flow is used to supercool the refrigeration cycle medium flow.

Two preferred embodiments of scroll machine 2 shown in FIG. 1 are described below with reference to FIGS. 2 to 7.

FIG. 2 shows a greatly simplified sectional representation of scroll machine 2 according to FIG. 1. Scroll machine 2 has a machine housing 10, designated as a whole, which is oriented along a longitudinal axis X. Machine housing 10 can have a plurality of housing sections, with machine housing 10 having a first housing section 10' and a second housing section 10" in the present exemplary embodiment.

A first scroll unit 100, a second scroll unit 200, an intermediate base 50 and a high-pressure chamber 30 are arranged in machine housing 10 along longitudinal axis X.

First scroll unit 100 is coupled via an eccentric bearing 150 to a drive shaft 420 that can be driven by a drive 400, drive shaft 420 being supported on machine housing 10 via a main bearing 350 and a secondary bearing 450. The axis of rotation of drive shaft 420 defines longitudinal axis X in the illustrated exemplary embodiment.

Figure 3:
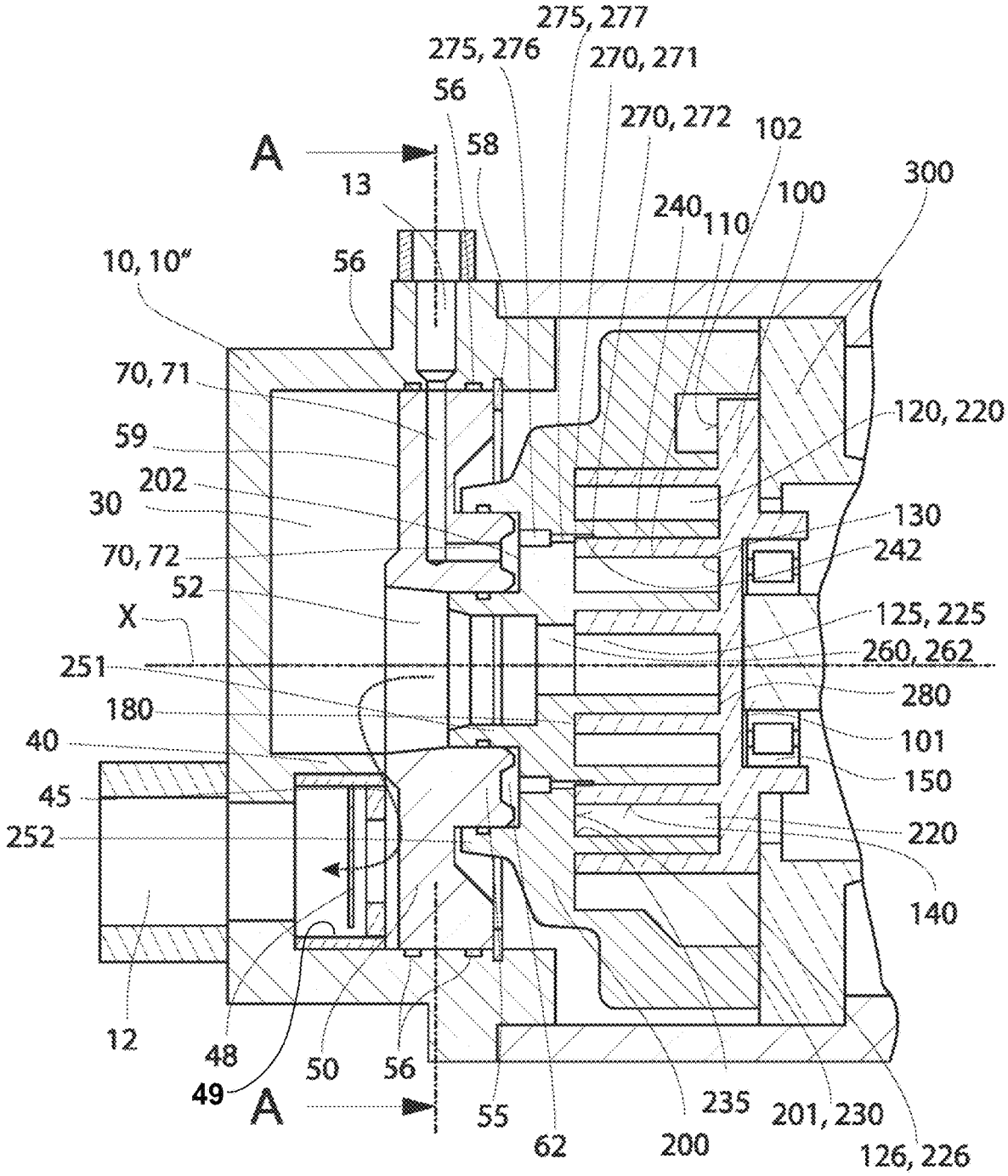
FIG. 3 shows an enlarged detailed representation of the scroll machine according to the first exemplary embodiment.

First scroll unit 100 according to FIG. 3 has a first side 101 and a second side 102 opposite first side 101 in the longitudinal axis. Eccentric bearing 150 is coupled to first scroll unit 100 on the side 101 and a first scroll rib 110 is arranged on second side 102, which protrudes along longitudinal axis X and forms a first scroll channel 120.

It can be seen in particular from FIG. 3 that first scroll rib 110 on second side 102 of first scroll unit 100 forms scroll channel 120 with a scroll channel base 130. On the face side, scroll rib 110 also has a first scroll rib tip 180, which can either have a seal or can be designed as a flat tip. Furthermore, first scroll channel 120 can have an inner end section 125 and/or an outer end section 126.

First scroll rib 110 is formed in the form of an evolvent and extends from inner end section 125 to outer end section 126. Inner end section 125 is located radially inward relative to longitudinal axis X and outer end section 126 is located radially outward relative to longitudinal axis X. The at least one scroll channel 120 is U-shaped and is delimited in the radial directions by scroll rib 110 or a scroll rib wall 140 of scroll rib 110 and scroll channel base 130.

Second scroll unit 200 can be stationary and has a first side 201 and a second side 202 opposite first side 201 in longitudinal axis X. A second scroll rib 210 protrudes in longitudinal axis X on first side 201, second scroll rib 210 forming a second scroll channel 220.

On the face side, second scroll rib 210 also has a second scroll rib tip 280, which can either have a seal or can be designed as a flat tip. Furthermore, second scroll channel 220 can have an inner end section 215 and/or an outer end section 216.

Second scroll rib 210 is adapted to first scroll rib 110 and is also formed in the form of an evolvent and extends from inner end section 215 to an outer end section 216. Inner end section 215 is located radially inward with respect to longitudinal axis X and outer end section 216 is located radially outside with respect to longitudinal axis X. The at least one second scroll channel 220 is U-shaped and is delimited in the radial directions by second scroll rib 210 or a scroll rib wall 240 of second scroll rib 210 and second scroll channel base 230.

As shown in FIG. 2, first scroll rib 110 of first scroll unit 100 and second scroll rib 210 of second scroll unit 200 engage with each other or intermesh. First scroll unit 100 can be moved by drive 400 along an orbital path (not shown) relative to second scroll unit 200. A guide device (not shown) prevents first scroll unit 100 from rotating about longitudinal axis X during movement along the orbital path.

When engaging with each other or intermeshing, first scroll rib 110 engages second scroll channel 220 and second scroll rib 210 engages first scroll channel 120. Second scroll rib tip 280 of second scroll rib 210 sealingly engages scroll channel base 130 of first scroll unit 100 and first scroll rib tip 180 of first scroll rib 110 interacts with scroll channel base 230 of second scroll unit 200.

During a movement of first scroll unit 100 along the orbital path, pressure chambers (not shown) are enclosed between first scroll unit 100 and second scroll unit 200, which are shifted depending on outer end section 126, 226 to the inner end section 125, 225, and vice versa.

In the event that scroll machine 2 operates as a scroll compressor or spiral compressor, the enclosed pressure chambers are shifted from outer end section 126, 226 to inner end section 125, 225, with the pressure chambers undergoing a continuous reduction in volume.

In a scroll expander, the pressure chambers undergo a continuous increase in volume and the pressure chambers are displaced from inner end section 125, 225 to outer end section 126, 226.

High-pressure chamber 30 and intermediate base 50 are arranged on second side 202 of second scroll unit 200, intermediate base 50 being arranged along longitudinal axis X between high-pressure chamber 30 and second scroll unit 200. Intermediate base 50 decouples the second scroll unit from the pressure forces in high-pressure chamber 30 and is supported in relation to machine housing 10.

High pressure chamber 30 is connected to second scroll channel 220 via a passage 260, passage 260 comprising an outlet port 262 which is arranged in the area of inner section 215. Outlet port 262, also known as the "discharge port", is preferably formed in inner end section 225 of second scroll channel base 230 and passage 260 extends along longitudinal axis X through an opening 52 through intermediate base 50 to high-pressure chamber 30.

High-pressure chamber 30 is in turn connected to outlet 12 and the medium can leave the scroll machine through outlet 12.

High-pressure chamber 30 is surrounded or enclosed by machine housing 10 and intermediate base 50. For this purpose, machine housing 10 or second housing section 10" can be pot-shaped with a recess, wherein intermediate base 50 can close high-pressure chamber 30 in machine housing 10 or second housing section 10" in the manner of a cover or plug. For this purpose, the shapes of the recess of second housing section 10" and intermediate base 50 are adapted to one another, with both the recess and intermediate base 50 preferably having a circular-cylindrical shape and being able to be designed to fit one another precisely.

In order to avoid leakage between intermediate base 50 and machine housing 10, first sealants 56 can be provided.

Intermediate base 50 has a first side and a second side, the first side facing the second scroll unit 200 and the second side facing high pressure chamber 30. Intermediate base 50 comprises opening 52 which is part of the passage and an annular projection 55 projecting on the first side of intermediate base 50 in longitudinal axis X from the first side of intermediate base 50 in the direction of second scroll unit 200. Annular projection 55 can have a radial groove on the free end face. Furthermore, the edges of annular projection 55 can have chamfers, which in particular can simplify installation of second scroll unit 200.

On the first side of intermediate base 50, an axial lock 58 can be arranged in the form of a securing ring that is attached in the machine housing 10, by means of which the position of intermediate base 50 in longitudinal axis X is determined. The axial lock 58 supports intermediate base 50 on machine housing 10 on the side facing second scroll unit 200, as a result of which the pressure forces from high-pressure chamber 30 are essentially decoupled from second scroll unit 200 and are coupled into machine housing 10.

Second scroll unit 200 surrounds annular projection 55 of intermediate base 50 and for this purpose has a first annular projection 251 and a second annular projection 252 on second side 202, first annular projection 251 interacting with an inner lateral surface of annular projection 55 and second annular projection 252 interacting with an outer lateral surface of annular projection 55 of intermediate base 50.

Annular projections 55 of intermediate base 50 and annular projections 251, 252 of the second scroll unit are arranged telescopically and can form a radial bearing for second scroll unit 200, which can allow an axial displacement of second scroll unit 200 relative to intermediate base 50, whereby, for example, manufacturing tolerances can be balanced.

To inject the medium, scroll machine 2 has a line 70 which connects a housing port 13—also called economizer inlet-to an injection port 270 in second scroll channel 220 of second scroll unit 200.

Figure 4:
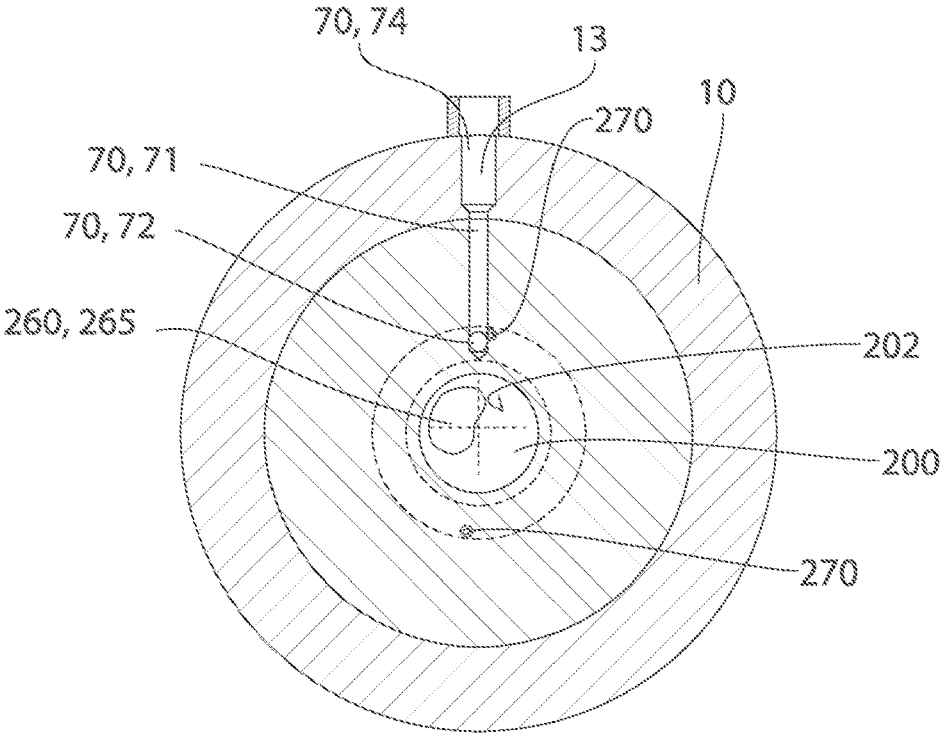
FIG. 4 shows a sectional representation through the scroll machine along the section line A-A according to FIG. 3.
Figure 6:
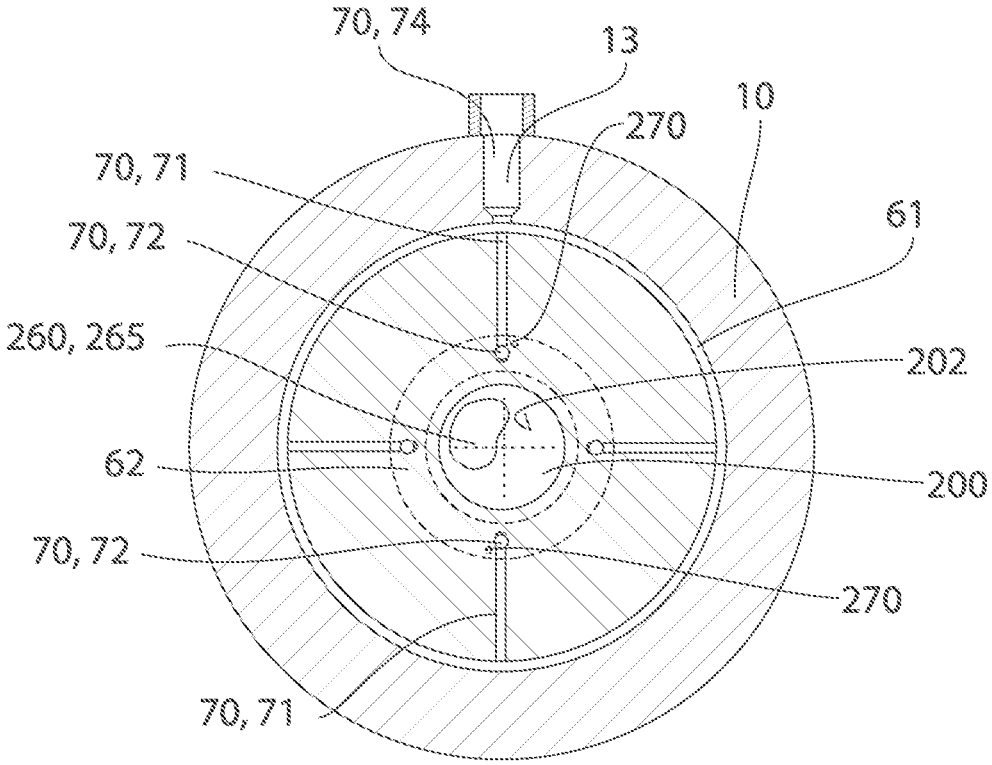
FIG. 6 shows a sectional representation of the scroll machine along the section line A-A according to FIG. 5.

With reference to FIGS. 4 and 6, injection port 270 is arranged in second scroll channel 220 between inner end section 215 and outer end section 216, wherein injection port 270, depending on the design of refrigeration system 1 or scroll machine 2, starting midway between inner end portion 215 and outer end portion 216 may be arranged shifted to inner end portion 215 or outer end portion 216.

Line 70 is routed from housing port 13 to injection port 270 through scroll machine 2 in such a way that line 70 is routed past high-pressure chamber 30 and not through high-pressure chamber 30.

For this purpose, line 70, as shown in FIG. 2, is routed past high-pressure chamber 30 from machine housing 10 through intermediate base 50 and then through second scroll unit 200 to injection port 270.

Line 70 has a housing line section 74 in machine housing 10, which is oriented radially according to the enlarged representation in FIG. 3 or 4 and connects housing port 13 to an inner lateral surface of machine housing 10 or second housing section 10".

Furthermore, line 70 in intermediate base 50 has a first line section 71 and a second line section 72. First line section 71 and second line section 72 are arranged in an L-shape, with first line section 71 preferably being formed with a substantially radial orientation and second line section 72 being formed with a substantially axial orientation. First line section 71 and second line section 72 can be formed, for example, by blind holes that intersect at a common intersection.

Referring to FIG. 4, it can be seen that intermediate base 50 should be positioned in machine housing 10 such that fluid communication can be established between first line section 71 and housing line section 74. Housing line section 74 preferably opens, preferably directly, into first line section 71, with housing line section 74 and first line section 71 even more preferably being aligned in aligning fashion. In order to prevent leakage from or into line 70, first sealant 56 described above can be arranged on both sides of line 70 in the longitudinal axis.

Second line section 72 can preferably be routed centrally through annular projection 55 and opens into a second intermediate space 62 which is formed between intermediate base 50 and second scroll unit 200. According to the preferred and illustrated exemplary embodiment, second intermediate space 62 is enclosed by annular projections 251, 252, wherein a second sealant 57 can be arranged in each case between annular projection 55 of the intermediate base and annular projections 251, 252, i.e. radially on the inside and outside. Intermediate space 62 surrounds passage 260.

From second intermediate space 62 the medium can flow from second side 202 to first side 201 of second scroll unit 200 through an opening 275 to injection port 270 in second scroll channel 220. Opening 275 is preferably formed in an axially orientation and can also be formed as a stepped opening 275 whose cross section tapers from a first section 276 to a second section 277 starting from second side 202 to first side 201.

Opening 275 can be designed as a bore. To form the stepped configuration, either opening 275 may be stepped or a nozzle of the desired shape may be inserted into opening 275. In principle, it is also possible to provide a plurality of openings 275 or injection ports 270 instead of a single opening 275 or a single injection port 270. Furthermore, opening 275 and/or injection port 270 can also be designed in the form of a slit or the like.

In particular, the enlarged representation according to FIG. 3 shows that injection port 270 comprises a recess 242 in second scroll rib 210 or in scroll rib wall 240. Recess 242 can be designed in the manner of a circular groove and extends in second scroll rib wall 240 from scroll channel base 230 in the direction of second scroll rib tip 280, it being apparent that recess 242 does not extend to second scroll rib tip 280, but only is formed over approximately 10% of the channel height of second scroll channel 220.

It can also be seen from FIG. 3 that injection port 270 extends over a transition area 235 between second scroll channel base 230 and second scroll rib 210 and has a first port section 271 in second scroll channel base 230 and a second port section 272 in second scroll rib 210, which is formed by recess 242 in scroll rib 210. In this way, injection port 270 can be positioned in such a way that, in particular, a seal on first scroll rib tip 180 of first scroll unit 100 is not guided over injection port 270 during the orbital movement. As a result, damage to both injection port 270 and the seal on first scroll rib tip 180 can be avoided.

Figure 5:
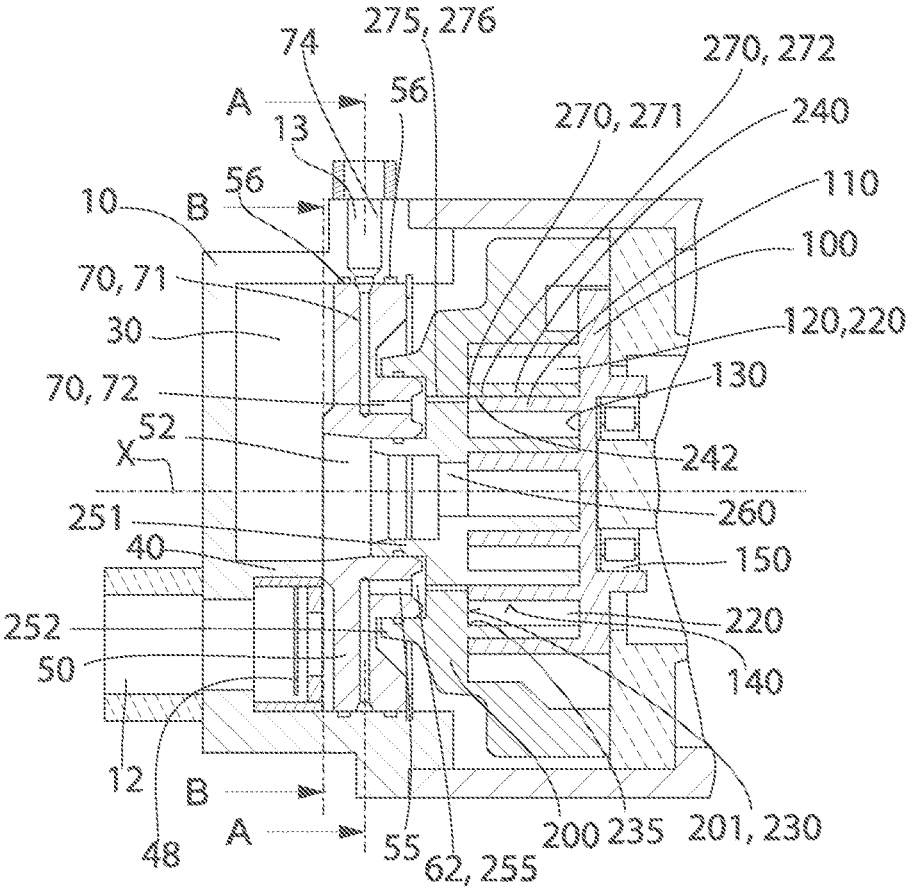
FIG. 5 shows an enlarged detailed representation of the scroll machine according to the second exemplary embodiment according to FIG. 2.

FIGS. 5 and 6 show a second preferred and exemplary embodiment of scroll machine 2, with the two exemplary embodiments differing in the design of line 70.

In particular with reference to FIG. 6 it is apparent that line 70 in intermediate base 50 is formed by a plurality of first line sections 71 and second line sections 72 distributed in pairs and connected in parallel over the circumference, said line sections preferably being evenly distributed over the circumference.

In the exemplary embodiment illustrated, line 70 is formed by four first line sections 71 and second line sections 72 connected in parallel and distributed over the circumference about the longitudinal axis X, with first line section 71 being in fluid communication with housing line section 74 via a first intermediate space 61. The number of lines 70 and/or first line sections 71 and/or second line sections 72 connected in parallel can be selected at the discretion of the person skilled in the art.

First intermediate space 61 is formed between machine housing 10 and intermediate base 50, first intermediate space 61 being formed by a radial groove in an outer lateral surface of intermediate base 50 in the illustrated and preferred exemplary embodiment. First intermediate space 61 is formed over the entire circumference of intermediate base 50 and distributes the medium coming from housing line section 74 over the circumference to first line sections 71.

Due to first intermediate space 61, it is not necessary to pay attention to the alignment of intermediate base 50 when inserting intermediate base 50 into the recess of machine housing 10 and, on the other hand, the medium is distributed over the circumference in intermediate base 50, resulting in a symmetrical thermal load from the medium in the intermediate base.

A refinement of the present invention that is not shown provides that line 70, in particular line 70 in intermediate base 50, is thermally insulated. The thermal insulation makes it possible to avoid a large input of heat into the medium to be injected before it enters scroll channel 220. The thermal insulation can be arranged, for example, on the side of intermediate base 50 facing high-pressure chamber 30, or directly around line 70.

Figure 7:
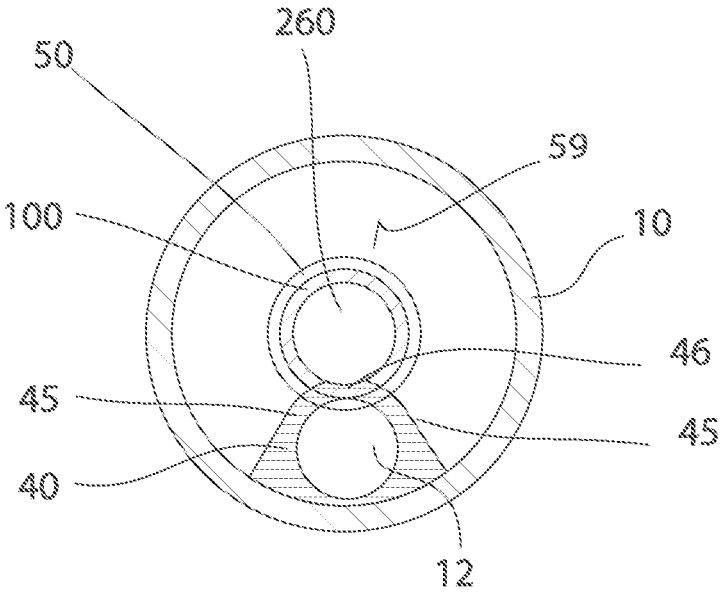
FIG. 7 shows a sectional representation of the scroll machine along the section line B-B according to FIG. 5.

The medium can reach outlet 12 from high-pressure chamber 30 via a pressure connection 40, pressure connection 40 preferably being arranged in such a way that the medium cannot flow directly from passage 260 into pressure connection 40. Pressure connection 40 according to the enlarged representation in FIG. 3 protrudes from the side of machine housing 10 facing intermediate base 50 in the direction of intermediate base 50 and, according to FIG. 7, is arranged offset to passage 260 in a plane perpendicular to longitudinal axis X.

In order to bring about a particularly effective reduction of pressure fluctuations in high-pressure chamber 30, a backflow area 45 can be provided, which forces an S-shaped flow path from passage 260 through pressure connection 40 to outlet 12, which is indicated in FIG. 3 by a dotted arrow line.

Return flow area 45 can have a preferably ring-shaped recess 59 on the second side of intermediate base 50, which faces high-pressure chamber 30, which, together with the pressure connection, defines the S-shaped flow path. For this purpose, pressure connection 40 is operatively connected with the intermediate base 50 according to FIG. 7 in a contact area 46, and that the contact area is arranged on an imaginary connecting line in a plane perpendicular to the longitudinal axis X between the pressure connection 40 and the passage 260. As a result, the medium coming from passage 260 must first be deflected in order to enter into recess 59 and from there to reach outlet 12 through pressure connection 40.

A check valve, shown in FIGS. 2, 3 and 5, can be arranged between high-pressure chamber 30 and outlet 12, which check valve 48 preferably comprises socket 49 which accepts a connection, which can be inserted in pressure connection 40.

LIST OF REFERENCE NUMERALS

1 refrigeration system
2 scroll machine
3 condenser
4 first expansion organ
5 evaporator
6 solenoid valve
7 second expansion organ
8 heat exchanger
9 machine housing
10 first housing section
10" second housing section
10 machine housing
11 inlet
12 outlet
13 housing port
30 high pressure chamber
30 high pressure chamber
40 pressure connection
45 backflow area
46 contact area
48 check valve
49 socket
50 intermediate base
52 opening
55 projection
56 first sealant
57 second sealant
58 axial lock
59 recess
61 first intermediate space
62 second intermediate space
63 radial groove
70 line
71 first line section
72 second line section
74 housing line section
100 first scroll unit
101 first side
102 second side
110 first scroll rib
120 first scroll canal
125 inner end section
126 outer end section
130 first scroll canal base
150 eccentric bearing
180 first scroll rib tip
200 second scroll unit
201 first side
202 second side
210 second scroll rib
220 second scroll canal
225 inner end section
226 outer end section
230 second scroll rib
230 channel base
235 transition area
240 second scroll rib wall
242 recess
251 projection
252 projection
260 passage

262 outlet port
270 injection port
271 first port section
272 second port section
275 opening
276 first section of 275
277 second section of 275
280 second scroll rib tip
300 main bearing housing
350 main bearing
400 drive
420 drive shaft
450 secondary bearing
E economizer cycle
M refrigeration cycle
X longitudinal axis

The invention claimed is:

1. A scroll machine (2) with an injection for a medium, having a machine housing (10) with a longitudinal axis (X), wherein a first scroll unit (100) with scroll channel (120) formed by a scroll rib (110), a second scroll unit (200) with a first side (201) and a second side (202) opposite the first side (201), wherein a scroll channel (220) formed by a second scroll rib (210) is provided on the first side (201), and a high-pressure chamber (30) which is arranged on the second side (202) of the second scroll unit (200) and connected with the scroll channel (220) via a passage (260) in the second scroll unit (200), and an intermediate base (50) are arranged in the machine housing (10) along the longitudinal axis (X), wherein the first scroll unit (100) and the second scroll unit (200) engage with each other to form pressure chambers, wherein the first scroll unit (100) can be moved relative to the second scroll unit (200) along an orbital path, wherein an intermediate base (50) is provided along the longitudinal axis (X) between the second scroll unit (200) and the high-pressure chamber (30), wherein a line (70) is provided for injecting the medium, which line connects a housing port (13) with an injection port (270) in the scroll channel (220) of the second scroll unit (200), and wherein the line (70) is routed from the housing port (13) past the high-pressure chamber (30) so as to bypass the high-pressure chamber (30) through the intermediate base (50), wherein the intermediate base (50) is held supported on the machine housing (10) on the side facing the second scroll unit (200) by means of an axial lock (58) or a shoulder of the machine housing (10), and wherein the intermediate base (50) encloses the high-pressure chamber (30) together with the machine housing (10).

2. The scroll machine (2) according to claim 1, characterized in that the intermediate base (50) is supported on the machine housing (10).

3. The scroll machine (2) according to claim 1, characterized in that the line (70) has a first intermediate space (71), the first intermediate space (71) being arranged between the intermediate base (50) and the machine housing (10).

4. The scroll machine (2) according to claim 1, characterized in that the first intermediate space (71) is formed by a preferably circumferential radial groove (63) in a cylindrical lateral surface of the intermediate base (50) and/or a cylindrical surface of the machine housing (10).

5. The scroll machine (2) according to claim 1, characterized in that the line (70) in the intermediate base (50) comprises a first line section (71) and a second line section (72), and that the first line section (71) and the second Line section (72) are arranged in an L-shape.

6. The scroll machine (2) according to claim 5, characterized in that the first line section (71) is oriented in a radial direction with respect to the longitudinal axis and the second line section (72) is oriented in an axial direction.

7. The scroll machine (2) according to claim 1, characterized in that the line (70) in the intermediate base (50) comprises at least two lines (70) connected in parallel.

8. The scroll machine (2) according to claim 1, characterized in that the second scroll unit (200) is supported on the intermediate base (50) so that it can move axially.

9. The scroll machine (2) according to claim 1, characterized in that the line (70) comprises a second intermediate space (72), the second intermediate space (72), preferably along the longitudinal axis (X), being arranged between the intermediate base (50) and the second scroll unit (200).

10. The scroll machine (2) according to claim 9, characterized in that the second intermediate space (62) is annular.

11. The scroll machine (2) according to claim 9, characterized in that the second intermediate space (62) is formed by annular projections (55, 251, 252) arranged telescopically along the longitudinal axis (X).

12. The scroll machine (2) according to claim 9, characterized in that the second intermediate space (62) is sealed by sealants (57) on the annular projections (55, 251, 252).

13. The scroll machine (2) according to claim 1, characterized in that the injection port (270) comprises a recess (242) in the scroll rib (210).

14. The scroll machine (2) according to claim 1, characterized in that the injection port (270) is arranged in a scroll channel base (230).

15. The scroll machine (2) according to claim 14, characterized in that the injection port (270) extends above a transition area (235) between the scroll channel base (230) and the scroll rib (210) and has a first port section (271) in the scroll channel base (230) and a second port portion (272) formed by the recess (242) in the scroll rib (210).

16. The scroll machine (2) according to claim 1, characterized in that the injection port (270) is formed by a stepped opening connecting the first face (201) to the opposite second face (202) of the second scroll unit (200).

17. The scroll machine (2) according to claim 1, characterized in that the line (70) and/or the injection port comprises a check valve (48).

18. The scroll machine (2) according to claim 1, characterized in that the line (70) is insulated and/or that the side of the intermediate base (50) facing the high-pressure chamber (30) has thermal insulation.

19. The scroll machine (2) according to claim 1, characterized in that the second scroll unit (200) is stationary.

20. The scroll machine (2) according to claim 1, characterized in that the second scroll unit (200) is connected to a main bearing housing (300) and surrounds the first scroll unit (100) with the main bearing housing (300).

21. A scroll machine (2) with an injection for a medium, having a machine housing (10) with a longitudinal axis (X), wherein a first scroll unit (100) with scroll channel (120) formed by a scroll rib (110), a second scroll unit (200) with a first side (201) and a second side (202) opposite the first side (201), wherein a scroll channel (220) formed by a second scroll rib (210) is provided on the first side (201), and a high-pressure chamber (30) which is arranged on the second side (202) of the second scroll unit (200) and connected with the scroll channel (220) via a passage (260) in the second scroll unit (200), are arranged in the machine housing (10) along the longitudinal axis (X), wherein the first scroll unit (100) and the second scroll unit (200) engage with each other to form pressure chambers, wherein the first scroll unit (100) can be moved relative to the second scroll unit (200) along an orbital path, wherein an intermediate base (50) is provided along the longitudinal axis (X) between the second scroll unit (200) and the high-pressure chamber (30), wherein a line (70) is provided for injecting the medium, which line connects a housing port (13) with an injection port (270) in the scroll channel (220) of the second scroll unit (200), and wherein the line (70) is routed from the housing port (13) past the high-pressure chamber (30) through the intermediate base (50)

characterized in that the high-pressure chamber (30) is connected to an outlet (12) via a pressure connection (40), the pressure connection (40) being arranged in a plane transverse to the longitudinal axis (X) offset from a passage (260) comprising an outlet port (262).

22. The scroll machine (2) according to claim 1, characterized in that a backflow area (45) is provided which forces an S-shaped flow path from the passage (260) through a pressure connection (40) to the outlet (12).

23. The scroll machine (2) according to claim 22, characterized in that the return flow area (45) is formed by a recess (59) formed in the intermediate base (50) on the side facing the high-pressure chamber (30) and the pressure connection (4) projecting towards the recess (59).

24. The scroll machine (2) according to claim 22, characterized in that the pressure connection (40) is operatively connected with the intermediate base (50) in a contact area (46) to form the return flow area (45), and in that the contact area (46) is arranged on an imaginary connecting line in a plane perpendicular to the longitudinal axis (X) between the pressure connection (40) and the passage (260).

25. The scroll machine (2) according to claim 22, characterized in that the pressure connection (40) comprises a socket (49) with a check valve.

26. A refrigeration system (1) with a scroll machine (2) according to claim 1.

27. A scroll machine (2) with an injection for a medium, having a machine housing (10) with a longitudinal axis (X), wherein a first scroll unit (100) with scroll channel (120) formed by a scroll rib (110), a second scroll unit (200) with a first side (201) and a second side (202) opposite the first side (201), wherein a scroll channel (220) formed by a second scroll rib (210) is provided on the first side (201), and a high-pressure chamber (30) which is arranged on the second side (202) of the second scroll unit (200) and connected with the scroll channel (220) via a passage (260) in the second scroll unit (200), are arranged in the machine housing (10) along the longitudinal axis (X), characterized in that the first intermediate space (71) is formed by a preferably circumferential radial groove (63) in a cylindrical lateral surface of the intermediate base (50) and/or a cylindrical surface of the machine housing (10), wherein the first scroll unit (100) and the second scroll unit (200) engage with each other to form pressure chambers, wherein the first scroll unit (100) can be moved relative to the second scroll unit (200) along an orbital path, wherein an intermediate base (50) is provided along the longitudinal axis (X) between the second scroll unit (200) and the high-pressure chamber (30), wherein a line (70) is provided for injecting the medium, which line connects a housing port (13) with an injection port (270) in the scroll channel (220) of the second scroll unit (200), and wherein the line (70) is routed from the housing port (13) past the high-pressure chamber (30) through the intermediate base (50).

* * * * *